United States Patent [19]

Ekins

[11] Patent Number: 4,751,748

[45] Date of Patent: Jun. 21, 1988

[54] SHIN GUARDS

[75] Inventor: David L. Ekins, Calabasas, Calif.

[73] Assignee: The Gold Belt Line, Inc., Reseda, Calif.

[21] Appl. No.: 836,016

[22] Filed: Mar. 4, 1986

[51] Int. Cl.[4] ..... A41D 13/00

[52] U.S. Cl. ..... 2/22; 2/24; 128/80 C

[58] Field of Search ..... 2/22, 24; 128/80 C, 128/80 F

[56] References Cited

U.S. PATENT DOCUMENTS

| | | | |
|---|---|---|---|
| 2,982,968 | 5/1961 | Groot | 2/22 |
| 3,194,233 | 7/1965 | Peckham | 2/24 X |
| 3,581,741 | 6/1971 | Rosman et al. | 2/22 X |
| 3,761,960 | 10/1973 | Woodcock | 2/22 |
| 4,139,002 | 2/1975 | Almedia | 128/80 C |
| 4,271,831 | 6/1981 | Deibert | 2/22 X |
| 4,493,316 | 1/1985 | Reed et al. | 128/80 C |
| 4,572,170 | 2/1986 | Cronk et al. | 128/80 C |

*Primary Examiner*—Louis K. Rimrodt
*Assistant Examiner*—J. L. Olds
*Attorney, Agent, or Firm*—Donald D. Mon

[57] ABSTRACT

A pair of guards for the knee and shin of the left leg and of the right leg of a user. Each guard has a shell-like knee protector and a shell-like shin protector. The protectors of each guard are joined by a pair of hinge pins whose hinge axes are common, and which axis slopes upwardly as it extends away from a vertical axis between the legs of a standing user.

5 Claims, 1 Drawing Sheet

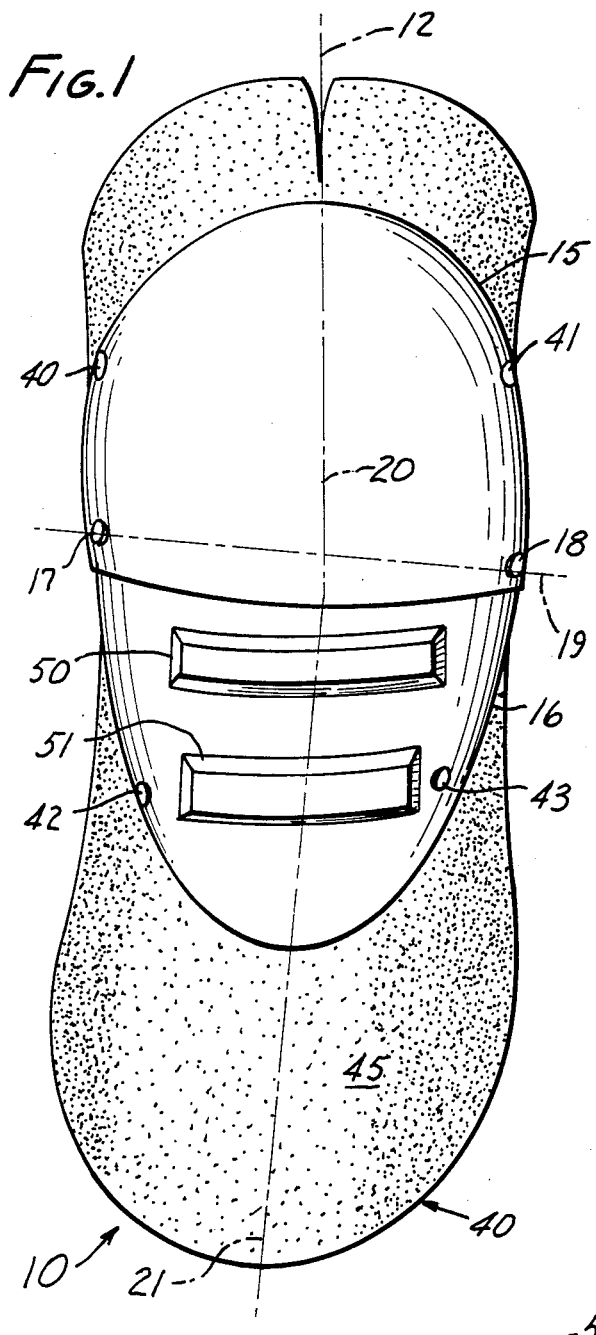
FIG. 1
12
15
41
40
20
17
18
19
50
16
51
42
43
45
40
10
21
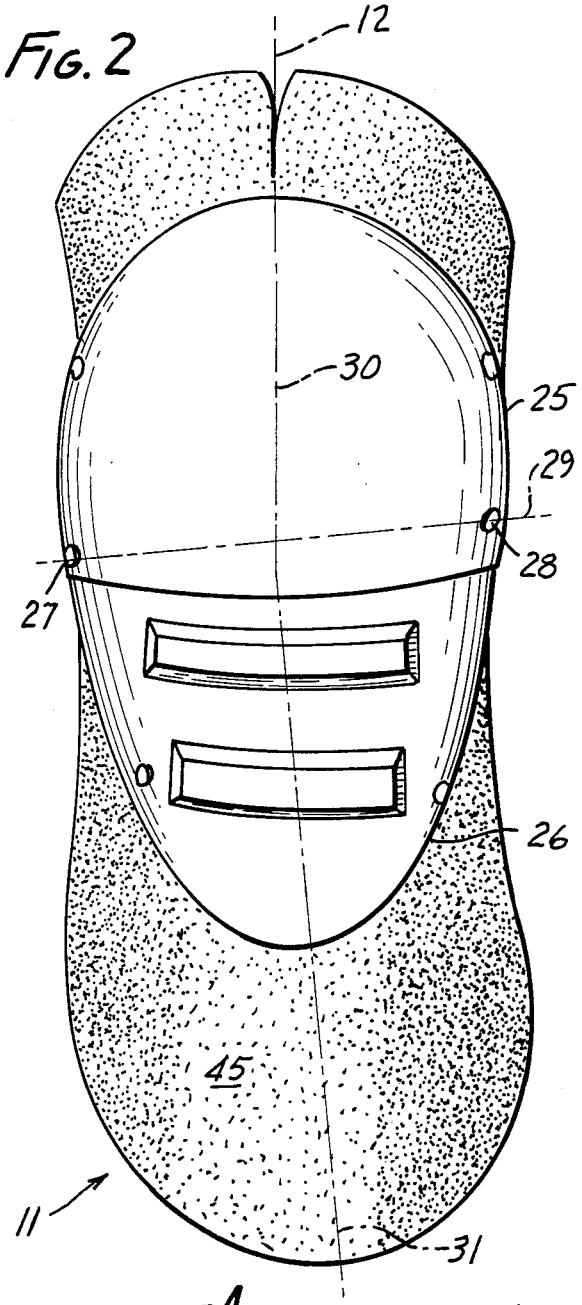
FIG. 2
12
30
25
29
28
27
26
45
11
31
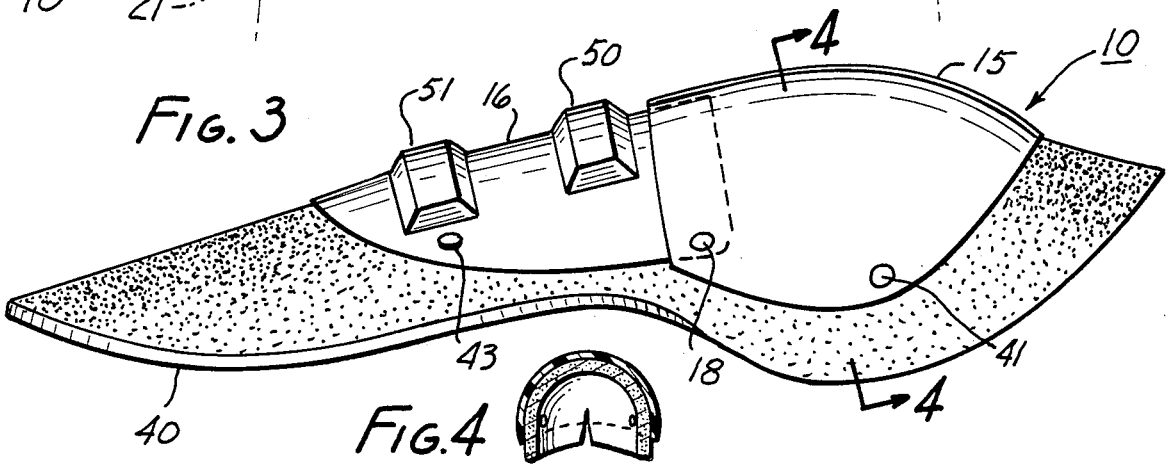
FIG. 3
51
16
50
4
15
10
43
18
41
40
4
FIG. 4

SHIN GUARDS

FIELD OF THE INVENTION

This invention relates to shin guards, aspecially for protection in the course of active operations wherein a wearer frequently changes his posture from crouched to standing, and to various postures between these two extremes.

BACKGROUND OF THE INVENTION

Especially in the field of motocross competition, but also in other vigorous activities, there is the need to protect the shins, and frequently also the knees, against impact by fixed, moving, or flying objects. In motocross operations, flying objects such as gravel, rocks, and debris regularly strike the knees and shins of the rider. Shin guards and knee guards are regularly and routinely worn to protect the rider from injury. Of course ths is not a situation limited to motocross alone. Hockey players represent yet another example of persons who require protection for these parts of the body.

However, motocross riders do present a rather special situation because of the frequency with which they change their posture. Riding a motorcycle vehicle over broken ground or a complicated course involves very frequent changes of posture to compensate for imbalance of the machine and rider, for changing side loads caused by change of forward direction, and for climbing or riding down slopes of varying complexity. All the while, full coverage of the knee and shin is required while the rider moves from a crouched (seated) to a standing posture, and to postures in between.

This raises considerable complications, because when the leg bends at the knee, the linear length to be protected changes. This fact is known by any person who wears a pair of tight pants. It is not an agreeable solution merely to provide stretchable material at the knee, because continuous protection of an agreed thickness or quality is needed. For this reason, it is known to provide a shell-like knee protector, and a shell-like shin protector pivoted together for hinging action, with an overlap of the two so that a gap between them does not exist.

The above would appear to be a suitable solution to the problem, because both the knee and shin are protected at all times against impacting objects. However, and rather surprisingly, this seemingly-suitable solution itself presents problems of its own.

Offhand, one would surmise that a person who indulges in a sport which involves violent maneuvers, substantial varying forces, and routine exposure to flying objects, would not look for comfort in his protective equipment, or be distracted by discomforts which would ordinarily be considered minor compared to the discomfiture that is endured merely by being on board a vehicle that is undergoing such severe operating conditions. But such is not the case. To the contrary, even champion riders will testify that long-continued minor discomforts, which might at the most cause a rash or abrasion, can be sufficiently distracting as to reduce the rider's performance by a small but important degree—one which conceivably could amount to the difference betwen championship or winning performance, and merely excellent performance. Also, when the riding is done for recreation rather than for competition, the elimination or lessening of such distractions or discomforts makes the sport much more agreeable.

The problem with the existing pivoted—together knee and shin protectors is that their pivot line is normal to both the thigh protector and to the shin protector, and thereby assumes that the shin bone and thigh rotate in a common plane. As a consequence, the two parts pivot in the same vertical plane. The problem is that the human joint is not constructed that way, and a flexure of at least 90 degrees is needed.

A person whose legs are anthropomorphically formed to the standard, standing with his thighs normal to the ground finds that his shin bones form an acute angle between them at the knees of about 14 degrees. The shin bone then pivots in a frusto-comical pattern, rather than in a plane. As a consequence, a shin protector which moves in a different mode, such as in the same plane as the thigh bones, will chafe the riders's leg. While padding can be provided to lessen the discomfort, such padding adds undesirable bulk and weight to the rider's competitive disadvantage, and does not solve the problem.

It is preferable for the knee and shin protectors to follow the body part with which they are associated. One solution, of course, is to mount each protector independently of the other. But this requires straps or other means to keep them in place, and it is quite possible that they will become separated or dislodged, so a to expose the rider to risk. A reliable, constant and structural pivotal joinder of the parts is much better and safer.

It is an object of this invention to provide a guard wherein the parts are pivotally joined, but pivot so that they follow the respective body element without substantial chafing.

BRIEF DESCRIPTION OF THE INVENTION

In this invention, a guard comprises a shell-like knee protector and a shell-like shin protector, which are pivotally joined together at a hinge line. Each protector has a nominal axis intended to extend parallel to the axis of the respective thigh or shinbone. The hinge line is oblique to one, and preferably to both, of said axes.

According to a preferred but optional feature of this invention, a pliable padding is joined to both of the protectors, forming a continuous underlying pad for comfort and comformability, and which may also be used to attach the guard.

The above and other features of this invention will be fully understood from the following detailed description and the accompanying drawings, in which:

BRIEF DESCRIPTION OF THE DRAWINGS

FIGS. 1 and 2 are a front view of the presently-preferred embodiment of the invention, respectively showing right and left leg protectors, the devices being symmetrical;

FIG. 3 is a side view of either of the protectors; and

FIG. 4 is a cross-section taken at line 4—4 in FIG. 3.

DETAILED DESCRIPTION OF THE INVENTION

In FIGS. 1 and 2, respectively there is shown right leg guard 10 and a left leg guard 11. These are related in the drawings to a common vertical axis 12, to which the thighs of the wearer are nominally parallel when he is standing. The guards are symmetrical across the axial plane normal to the sheet of drawings, and in that sense they are mirror images.

Right leg guard 10 comprises a shell-like knee protector 15, a shell-like shin protector 16, and a pair of hinge pins 17, 18 joining them. A hinge axis 19 extends between hinge pins 17, 18. The knee protector has a nominal axis 20 which is parallel to vertical axis 12 when the rider stands erect. The shin protector has a nominal axis 21 that is parallel to the respective shin bone.

Left leg guard 11 comprises a shell-like knee protector 25, a shell-like shin protector 26 and a pair of hinge pins 27, 28 joining them. A hinge axis 29 extends between hinge pins 27 and 28. The knee protector has a nominal axis 30 which is parallel to vertical axis 12 (and to axis 20) when the rider stands erect. The shin protector has a nominal axis 31 that is parallel to the respective shin bone.

Hinge axes 19 and 29 are oblique (not normal to) axes 12, 20 and 30. In fact, they form an acute angle with the horizontal. They are oppositely slanted, and axes 21 and 31 of the shin protectors form an angle between them. They are not parallel.

The hinge axes are not normal to one of the axes of each leg, and preferably are not normal to either.

A pad 40 is shaped concavely, comfortably and conformably to fit over the knee, especially when the knee is slightly bent. It is made of a pliable foam, perhaps 5/16" thick, and is fixed to the protectors by rivets 41, 42, 43, 44. Such a pad, similarly mounted, is attached to each set of protectors. The pad will deform suitably between the points where the protectors are hinged relative to one another. Each pad has a bill 45 depending substantially below the respective shin protector. This can be tucked into a pocket on the trousers of the wearer to attach the guard, should straps or the like not be desired as they usually will not.

Ribs 50, 51 may be formed on the shin protectors the better to deflect rocks and debris. The protectors themselves may conveniently be made of a high impact resistant molded organic plastic material such as polystyrene.

Thus there is a matched pair of guards each of which readily hinges to follow the movements of the rider without chafing. Flexure through 90 degrees is readily attained.

This invention is not to be limited by the embodiment shown in the drawings and described in the description, which is given by way of example and not of limitation, but only in accordance with the scope of the appended claims.

I claim:

1. A pair of guards for the knee and shin of the left leg and of the right leg of a user, each guard comprising a shell-like knee protector concavely shaped to fit over the user's knee and having a nominal axis parallel to the nominal axis of the respective thigh when worn by the user, a shell-like shin protector concavely shaped to fit over the front of the user's shin and having a nominal axis parallel to that of the respective shin when worn by the user, a pair of individual single hinge pins for each of said left leg and right leg guards, each pair of said hinge pins hingedly joining its respective knee protector and shin protector, each said pair of hinge pins being aligned on a respective hinge axis, each pair of hinge pins being the sole interconnections of its respective protectors, each said hinge axis sloping upwardly as it extends away from a vertical axis between the legs of a standing user.

2. A pair of guards according to claim 1 in which said knee protector and shin protector are sufficiently hard to resist impact by other bodies.

3. A pair of guards according to claim 2 in which a pliable pad is attached at a plurality of points to said knee protector and shin protector whereby to be comformable to the user when the user changes his posture.

4. A pair of guards according to claim 3 in which said pad is attached to said knee protector and shin protector only at a plurality of spaced-apart points.

5. A pair of guards according to claim 2 in which said hinge axis is oblique to both nominal axes.

* * * * *